US005394376A

United States Patent [19]

Riddle et al.

[11] Patent Number: 5,394,376

[45] Date of Patent: Feb. 28, 1995

[54] METHOD AND APPARATUS FOR ACOUSTIC ATTENUATION

[75] Inventors: Laurence R. Riddle, Severna Park; John M. Sewell, Cockeysville; Paul H. Kurtz, Bel Air, all of Md.

[73] Assignee: Martin Marietta Corporation, Bethesda, Md.

[21] Appl. No.: 168,318

[22] Filed: Dec. 17, 1993

[51] Int. Cl.[6] ..... G10K 11/16

[52] U.S. Cl. ..... 367/1; 367/901; 381/71

[58] Field of Search ..... 367/901, 1; 364/574; 381/71, 94

[56] References Cited

U.S. PATENT DOCUMENTS 4,562,589 12/1985 Warnaka et al. ..... 381/71
4,700,803 10/1987 Mallet et al. ..... 367/156
5,206,911 4/1993 Eriksson et al. ..... 381/71

FOREIGN PATENT DOCUMENTS

WO81/01479 5/1981 United Kingdom .

OTHER PUBLICATIONS

W. Webbon, et al., "Active Vibration Control Using Magnetostrictive Intra-Structural Actuators," Second Conference on Recent Advances in Active Control of Sound and Vibration (1993).

J. Thi, et al., "Comparison of Design Approaches in Sound Radiation Suppression," 534–551 (1991).

Samuel E. Craig and O. L. Angevine, "Active Control of Hum from Large Power Transformers—The Real World," Second Conference on Recent Advances in Active Control of Sound and Vibration (1993).

C. F. Ross, "Experiments on the Active Control of Transformer Noise," Journal of Sound and Vibration 473–480 (1978).

*Primary Examiner*—Daniel T. Pihulic
*Attorney, Agent, or Firm*—Gay Chin; Bruce M. Winchell; William H. Meise

[57] ABSTRACT

An apparatus for reducing acoustic radiation from an enclosure containing a fluid includes one or more vibration sensors in communication with surfaces of the enclosure. The vibration sensors feed signals corresponding to detected vibrations in the surface to a radiation filter. The radiation filter assigns weights to the signals and generates a summation signal which is then input to a control unit, with the summation signal ideally representing only those vibrations that will actually radiate from the enclosure. The control unit uses a reference signal and the summation signal to calculate a cancellation waveform to offset the cause of the detected vibrations. The cancellation signal is input to a fluid displacement unit which applies pressure oscillations to the fluid corresponding to the cancellation waveform.

2 Claims, 3 Drawing Sheets

METHOD AND APPARATUS FOR ACOUSTIC ATTENUATION

BACKGROUND OF THE INVENTION

The invention relates to the field of acoustic attenuation, and specifically to an apparatus and method for the active cancellation of acoustic waves radiating from a fluid-containing enclosure. The present invention is particularly useful for reducing noise generated by industrial equipment having a noise source connected to a radiating surface via a fluid transmission path, such as an oil-filled transformer of a type commonly used in residential power sub-stations.

Many current industrial systems, including transformers and refrigeration units, generate noise at levels that are unacceptable for residential areas, often exceeding limits set by local ordinances. In an oil-filled transformer, for example, this noise is the result of vibrations induced by the core of the transformer passing through the surrounding oil and radiating out to the atmosphere through the walls of the oil-containing tank. It is often economically necessary to locate such a transformer close to a residential area; however, the constant hum produced by the transformer is a source of irritation to those who live within range of the noise. Accordingly, there is a need for an economical means for reducing the noise generated by such equipment.

Early approaches to the problem of excessive noise generated by fluid-filled transformers included installation of quieter transformers or de-rating the load carried by existing transformers. The former approach involves a significant capital expenditure, usually including price premiums for quieter designs; while the latter approach is not practical for many existing installations. Yet another approach involves building sound walls around transformers, but such physical barriers are expensive to construct and generally interfere with the high voltage lines coming into the sub-station.

More recent approaches to the problem focused on noise cancellation systems. One such system involves the use of loudspeakers to produce an external control volume in an effort to cancel the airborne noise radiation around the industrial system. Such loudspeaker-based systems have proven to be unreliable and often experience an unsatisfactory degree of variability as a result of changes in weather and ambient noise. A system of this type is described in Samuel E. Craig and O. L. Angevine, *Active Control of Hum from Large Power Transformers—The Real World,* Second Conference on Recent Advances in Active Control of Sound and Vibration 279–290 (1993).

A more satisfactory approach to reducing excessive noise radiated from a fluid-bearing enclosure involves active attenuation of fluid-borne noise through the use of a canceling vibration applied to the fluid. One such method is described in PCT patent application WO 81/01479, filed by George B. Chaplin on Nov. 10, 1980. The Chaplin application discloses the use of a harmonic generator and a vibrator device to introduce a secondary vibration into a fluid-containing transformer tank, thereby reducing the hum produced by a primary vibration emanating from the transformer core. The harmonic generator taps an AC signal from a power line feeding the transformer core and uses a pass filter, a variable phase shifter and a variable amplitude control to produce signals corresponding to the $2f$, $4f$ and $6f$ harmonics of the AC signal. These signals are then fed to a summation means and a power amplifier prior to being input to the vibrator device. As the vibrator device is activated, a series of microphones or vibration sensors are monitored to ascertain the effect on the hum produced by the transformer. Incremental adjustments may then be made to the individual harmonics to attain an optimum noise level and compensate for changes occurring in the primary vibration generated by the transformer core.

While representing a promising approach, the Chaplin invention requires an excessively complex attenuation system to achieve an acceptable level of cancellation performance. Acceptable cancellation performance is generally defined as reducing by at least one-half the sound power radiated by an enclosure. Chaplin is deficient in that the disclosed invention processes the entire set of pressure fluctuation patterns in an enclosed liquid, as opposed to extracting only those components that are responsible for the radiated sound. This results in a significant increase in system complexity, since the actuators must try to match (with a 180° phase shift) very complex spatial patterns detected by the vibration sensors.

SUMMARY OF THE INVENTION

The drawbacks of known approaches to noise attenuation systems are overcome by the apparatus and method of the present invention. The invention uses an adaptive digital controller and a high-energy broadband fluid displacement unit to suppress unwanted noise radiation from a fluid-containing structure.

An apparatus for reducing acoustic radiation in a fluid-containing enclosure according to the present invention includes a vibration sensor in communication with a surface of the enclosure, a radiation filter coupled to the vibration sensor, a control unit coupled to the radiation filter, and a fluid displacement unit coupled to the control unit and in communication with the fluid in the enclosure. The fluid displacement unit is capable of displacing fluid in response to signals from the control unit.

A possible embodiment of the present invention includes one or more vibration sensors in communication with surfaces of a fluid-containing enclosure, such as the oil-filled tank of an industrial transformer. The vibration sensors detect vibrations in the surfaces caused by pressure oscillations in the contained fluid and generate signals representative of those vibrations, which signals are then passed to a radiation filter coupled to the vibration sensors. The radiation filter assigns individual weight values to each of the signals and sums the weighted signals to generate a signal representative of the waveform that is radiating from the surfaces of the enclosure. The output of the radiation filter is then input to a control unit which may perform an analog-to-digital conversion prior to executing a cancellation algorithm. The result of the cancellation algorithm, representing a signal designed to cancel the radiated waveform, is then input as a composite actuator command to a fluid displacement unit. The composite actuator command causes the fluid displacement unit to generate responsive pressure oscillations that are propagated within the enclosure, thereby canceling the pressure oscillations causing the acoustic radiation from the enclosure walls.

A vibration sensor for use with the present invention may be any suitable accelerometer of a type known in the art which exhibits a satisfactorily high degree of sensitivity and a desirably low degree of distortion. The vibration sensors are adapted to transmit signals to a radiation filter corresponding to the magnitude of detected movements in the surface of the enclosure.

A radiation filter for use with the present invention ideally includes a software-based weighting network which processes input from the vibration sensors to eliminate any sensed vibrations that will not radiate to the atmosphere through the walls of the enclosure. Such a radiation filter may employ a spatial wavenumber filtering approach of a type known in the art. The radiation filter is further adapted to feed a signal to a control unit representing the waveform causing the acoustic radiation.

The use of a radiation filter provides significant advantages over prior art noise attenuation techniques. When the non-radiating portion of detected vibrations is filtered out, the resulting vibration pattern is significantly smoother and more uniform than the total vibration pattern. Moreover, the wavelength of tank wall vibrations that actually radiate into the atmosphere will generally be larger and more uniform than the dominant wall vibration, at least in those cases where the transformer harmonics sought to be controlled are below the coincidence frequency for the tank wall. The coincidence frequency is the frequency of vibration at which wavelengths in the enclosure wall equal the wavelengths in the atmosphere. The frequencies that are typically most annoying to persons near a radiating enclosure (e.g., 120 Hz, 240 Hz, 480 Hz) are below the coincidence frequency; thus, the present invention is able to take advantage of the simpler vibration patterns by employing fewer actuators for effective cancellation.

A control unit executes a cancellation algorithm to calculate a cancellation waveform for the radiating vibrations using input from the radiation filter and a reference signal. The reference signal processed by the control unit is preferably obtained from an outside source, such as the AC power line feeding the control unit. In general, a suitable reference signal must include a frequency component having a fundamental or harmonic frequency equal to the harmonics of the undesirable acoustic radiation. In the case of tapping an AC power supply, the power source would contain a signal at 60 Hz and the harmonics being controlled would include 120 Hz, 240 Hz and 360 Hz.

In one embodiment of the present invention, the control unit executes an improved cancellation algorithm having means for adjusting the phase and amplitude between the reference signal and the radiation filter output signal using an inverse transfer function filtering characteristic. This approach represents an improvement over the prior art since the closed loop gain of the present invention is independent of the system response being canceled.

A fluid displacement unit translates the canceling waveform calculated by the control unit into pressure oscillations that propagate through the fluid in the enclosure, thereby reducing acoustic radiation from the enclosure by reducing or eliminating the cause of vibrations in surfaces of the enclosure. A fluid displacement unit suitable for use with the present invention should be capable of displacing a volume of fluid equal to that displaced by the pressure fluctuations causing the unwanted acoustic radiation. Moreover, the fluid displacement unit should be capable of operating over the entire frequency range of the detected pressure fluctuations.

In a preferred embodiment, the fluid displacement unit may be based on a broadband solid state actuator element ideally including a magnetostrictive alloy, wherein the composite actuator command generated by the control unit is input to a power amplifier that outputs a current sufficient to generate magnetic fields from coils surrounding the actuator element. The resulting change in magnetic field causes the actuator section to undergo magnetostriction, thereby causing a change in the length of the actuator element. This effect could also be achieved by generating an electric field around an actuator element including an electrostrictive alloy. In either case, the change in length causes a surrounding diaphragm to expand and contract, giving rise to a fluid pressure and volume change at an output port of the fluid displacement unit which creates pressure oscillations that propagate throughout the fluid.

A method for reducing acoustic radiation in a fluid-containing enclosure according to the present invention involves locating a plurality of vibration sensors in communication with one or more surfaces of the enclosure. As each vibration sensor detects motion in a surface, it emits a representative signal that is input to a device for generation of a summation signal. The summation signal can be used to calculate a cancellation waveform sufficient to reduce or eliminate the cause of the vibrations. The cancellation waveform is propagated through the fluid by means of pressure oscillations corresponding to the cancellation waveform.

The apparatus and method of the present invention can be used to quiet existing industrial machinery, such as oil-filled transformers, more economically than was possible with previously known devices and methods. A unique advantage of the present invention lies in the use of harmonic cancellation to not only eliminate harmonics of the fluid disturbance, but to also reduce harmonic distortion generated by the fluid displacement unit itself. An additional advantage of the present invention lies in the use of a broadband solid state actuator in the fluid displacement unit. Unlike most known devices for displacing fluid, such a unit is capable of simultaneously operating at multiple frequencies. Moreover, the solid state design provides a high degree of reliability due to the lack of moving parts.

DETAILED DESCRIPTION

Figure 1:
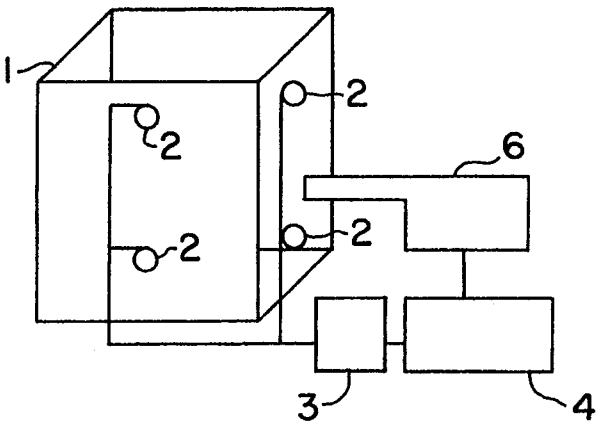
FIG. 1 is a block diagram of a system for the active cancellation of fluid-induced acoustic radiation according to the present invention.

FIG. 1 is an embodiment of an apparatus for actively canceling fluid-induced acoustic radiation according to the present invention. The apparatus may effectively be used on any enclosure 1 containing fluid and capable of radiating acoustic waves.

One or more vibration sensors 2 are positioned in communication with surfaces of the enclosure 1, and are capable of generating signals representative of vibrations detected in the surfaces. These signals may be either analog or digital. The vibration sensors 2 may comprise any suitable accelerometer of a type known in the art which exhibits a high degree of sensitivity and a low degree of distortion. An example of such a device is the "ENDEVECO MODEL 2217-A" analog accelerometer.

The vibration sensors 2 feed their signals to a radiation filter 3, which assigns weight values to each of the signals according to the position of the associated vibration sensor 2 and generates a signal representing a summation of all the vibrations which would ultimately radiate to the environment as acoustic waves. This summation signal is then input to a control unit 4, which preferably comprises a digital control unit. A hardware platform for a control unit suitable for use in the present invention comprises a 486 DX 33 MHz personal computer equipped with an analog to digital conversion (ADC) board and a digital signal processor (DSP) board.

Where the vibration sensors emit analog signals, the control unit 4 may first subject the summation signal to an analog-to-digital converter to generate a digital representation of the signal. The control unit 4 then processes the signal, along with a reference signal tapped from the AC power supply feeding the control unit 4, using an n-degree of freedom cancellation algorithm. The control unit 4 uses the output from the cancellation algorithm, representing a waveform capable of canceling the cause of the radiating vibrations originally detected by the vibration sensors 2, to generate a composite actuator command for input to the fluid displacement unit 6.

The fluid displacement unit 6 may comprise a pressure compensated diaphragm that is capable of propagating pressure oscillations to the fluid contained in enclosure 1 in response to the composite actuator command. The pressure oscillation generated by the fluid displacement unit offsets the cause of the earlier-detected vibrations, thereby substantially reducing or eliminating the noise radiated from the surfaces of the enclosure 1.

Figure 2:
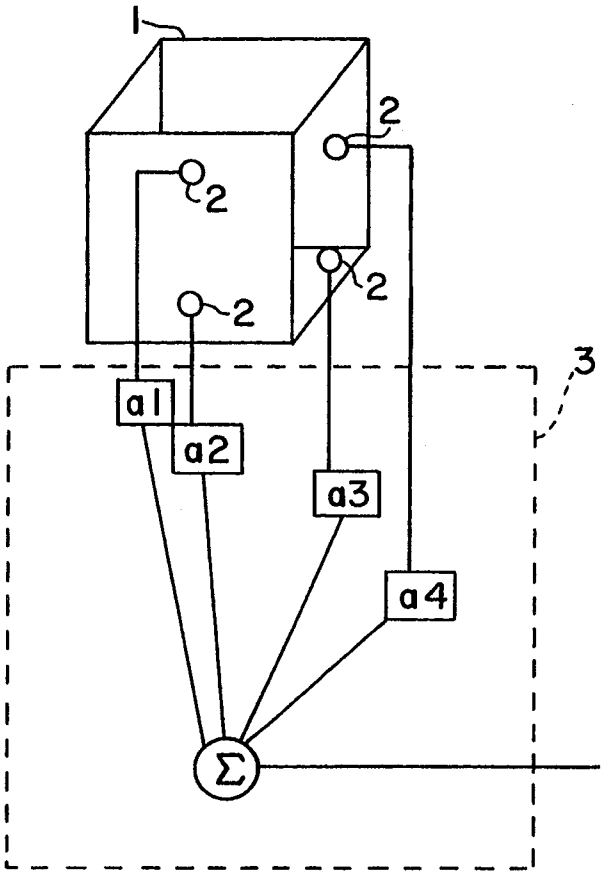
FIG. 2 is a block diagram of a radiation filter for use with the present invention.

FIG. 2 provides a more detailed view of an embodiment of a radiation filter 3 for use with the present invention. The radiation filter 3 receives signals representing vibrations in surfaces of the enclosure 1 detected by the four vibration sensors 2. The number of vibration sensors 2 depicted in FIG. 2 was selected purely for illustration purposes; the actual number that may be used is variable, though the effectiveness of the present invention will increase with greater density of coverage in relation to the total surface area of the enclosure 1.

The radiation filter 3, after performing preliminary signal conditioning, assigns weights values to each of the received signals. These weight values, denoted a1 through a4 in FIG. 2, are chosen so that the principal radiating component of the detected vibrations is preferentially passed through the radiation filter 3 and non-radiating modes, such as vibrations where the enclosure wall velocity at individual sensor locations are of the same magnitude but with alternating sign, are attenuated.

The weight values are assigned by first analyzing the enclosure for which noise attenuation is desired to determine the dominant radiating vibration patterns. The dominant vibration patterns will generally be a series of sinusoidal patterns extending in the two directions in plane with the tank wall. A matched filtering action may then be achieved by locating vibration sensors near the anti-nodes of the dominant vibration pattern and assigning weight values according to the radiation pattern amplitude. This matched filtering action will generally accentuate the radiating pattern vibration level with respect to the non-radiating patterns. In many cases, the principal radiating pattern will have a broad anti-node that extends over the entire enclosure surface.

Radiation filters suitable for use with the present invention are known in the art. The radiation filter 3 is preferably a software-based apparatus, although nothing precludes the use of a hard-wired equivalent. In a preferred embodiment of the present invention, the radiation filter comprises a spatial wavenumber filter adapted to suppress only the wavenumber components of the detected vibrations that will radiate to the atmosphere. Such an approach to acoustic filtering is described in J. Thi et al., *Comparison of Design Approaches in Sound Radiation Suppression,* Recent Advances in Active Control of Sound and Vibrations (1991), the disclosure of which is incorporated herein by reference.

After assigning weight values to the vibration signals, the radiation filter 3 performs a summation of the weighted signals. The resulting summation signal is then output to the control unit coupled to the radiation filter 3 for further processing.

Figure 3:
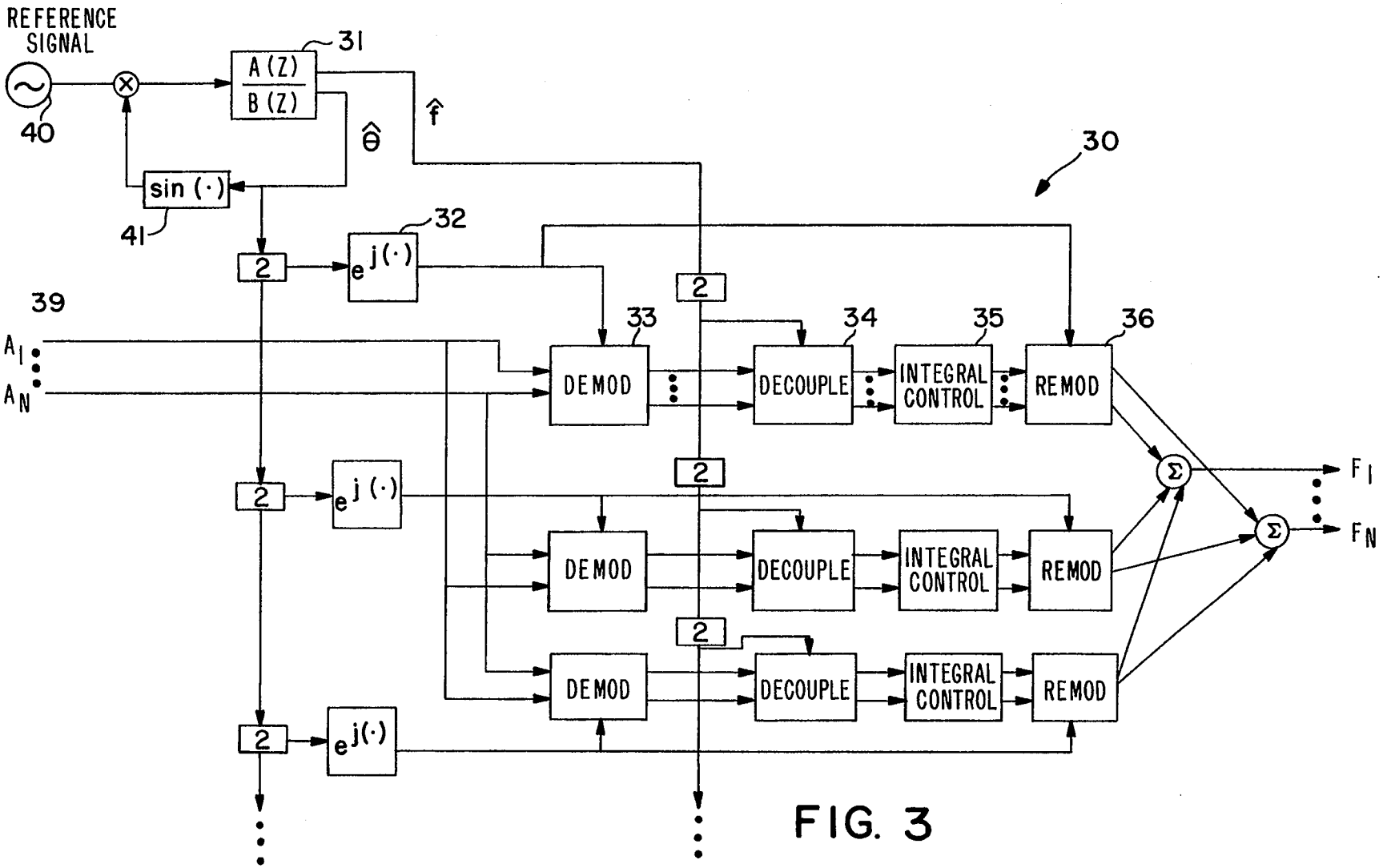
FIG. 3 is a block diagram of a cancellation algorithm capable of generating composite actuator commands corresponding to a cancellation signal.

FIG. 3 is a block diagram representing an embodiment of an n-degree of freedom cancellation algorithm 30 which may be used to generate a cancellation signal in accordance with the present invention. The cancellation algorithm 30 calculates a waveform providing cancellation at a first harmonic of an input reference signal 40 and other desired harmonics. While the specific harmonics for which cancellation is desirable will vary by application, in general the lower frequency harmonics are more disruptive and aggravating to persons in the area of a sound-radiating enclosure such as a transformer tank.

Unlike prior art cancellation algorithms, the n-degree of freedom cancellation algorithm 30 is capable of generating multiple independent actuator command signals, as opposed to merely generating a single actuator command corresponding to a single vibration sensor. Here, "n" corresponds to the number of fluid displacement units available for affecting the cancellation. This number will again vary by application, but is largely determined by the magnitude of the acoustic frequencies to be canceled and the size of the radiating enclosure. Each degree of freedom can include a multiple of harmonics to be canceled. Thus, a 2-actuator/4-harmonic cancellation algorithm has two degrees of freedom, with each degree of freedom controlling 4 different harmonics.

The particular harmonics to be canceled may vary by application, but are generally chosen to eliminate as much of the low frequency noise as required, as well as their related distortion products. To illustrate, assume the undesirable harmonics (when the system of the present invention is inoperative) include 120 Hz, 240 Hz and 360 Hz. A noise attenuation system according to the present invention would then include a cancellation algorithm designed to eliminate those frequencies. Additionally, the cancellation algorithm would preferably be designed to cancel 480 Hz, 720 Hz, and possibly 840 Hz to cancel the distortion introduced by the actuators themselves.

The reference signal 40 is obtained by tapping an AC power line, such as that feeding the control unit. Such a signal will have a frequency content that includes the fundamental frequency of the harmonics being canceled. The cancellation algorithm 30 passes the reference signal 40 through a phase-locked loop filter 31 and a trigonometric function 41 to detect, track and enhance the instantaneous phase angle of the reference signal, which is assumed to be a slowly varying sinusoid, and output the result as an estimated phase angle $\hat{\theta}$. The phase-locked loop filter 31 also generates a frequency estimate $\hat{f}$ for use in subsequent processing.

The phase estimate $\hat{\theta}$ is multiplied by 2 and passed through a complex trigonometric function 32 to generate the first harmonic of the reference signal 40 as a complex-valued analytic signal, where the imaginary component has a 90° variation in phase angle from the real component. This signal is then used as a local carrier by the demodulating function 33 to perform complex heterodyning of the radiation filter input 39, comprising the summation signal discussed with reference to FIG. 2. This operation effectively frequency shifts the radiation filter input 39 so that the amplitude and phase of the radiation filter signal at the harmonic frequency corresponding to the local carrier occurs at zero frequency (i.e., DC) on the output of the demodulation function. Thus, the demodulating function 33 outputs a complex-valued signal having a DC component representative of the estimated radiated signal from the radiation filter summation signal.

The demodulated signal is then passed through a decoupling function 34, which performs a complex vector-matrix multiplication with the vector of all n-degrees of freedom demodulated signals, at the same frequency, where the matrix is the multi-channel inverse transfer function at the frequency being canceled. The multi-channel inverse transfer function is a frequency-dependent matrix of complex values, where the inverse matrix when multiplied by the original multi-channel transfer function matrix yields the identity matrix. The transfer function whose inverse is used in the cancellation algorithm corresponds to the amplitude and phase change in the digitized radiation filter summation signal when a sinusoid actuator command is generated by the control unit. Since there may be numerous actuators and radiation filters, these amplitude and phase changes become a matrix-valued expression.

The decoupled signal is then passed through an integral control law 35 to convert the DC component of the decoupled reference signal into a disturbance rejection signal at DC. The integral control law corresponds to the changing of the demodulated cancellation weight "w" by use of the demodulated radiation filter signal "e" according to the following expression:

$$w(k+1)=aw(k)+b(e(k))$$

where "k" is a time index, "a" is close to (but never greater than) one, and "b" is typically a small value, such as 0.01. The vector signal output from the integral control law 35 is then remodulated by the remodulating function 36 back to the frequency of cancellation. The remodulating function 36 is substantially the same as the demodulating function 33, but uses the complex conjugate of the carrier signal. The remodulating function 36 thus shifts back to the carrier frequency the integral control value generated by the integral control law 35.

The cancellation algorithm 30 is capable of concurrently processing inputs from a plurality of radiation filters, depicted as $A_1$ through $A_n$, with each filter corresponding to a plurality of frequencies for which cancellation is desired. As shown in FIG. 3, the individual radiation filter summation signals are processed identically through the demodulating function 33, decoupling module 34, integral control law 35 and remodulating function 36. For each input radiation filter summation signal, the cancellation algorithm 30 generates a respective composite actuator command $F_n$ by summing the remodulated signal vector components with the other frequencies being canceled. In such a system, the number of independent radiation filter inputs to the algorithm should equal or exceed the number of independent actuator channels. The optimum number for any given application will be determined by balancing the competing factors of acoustic cancellation performance and system complexity.

Figure 4:
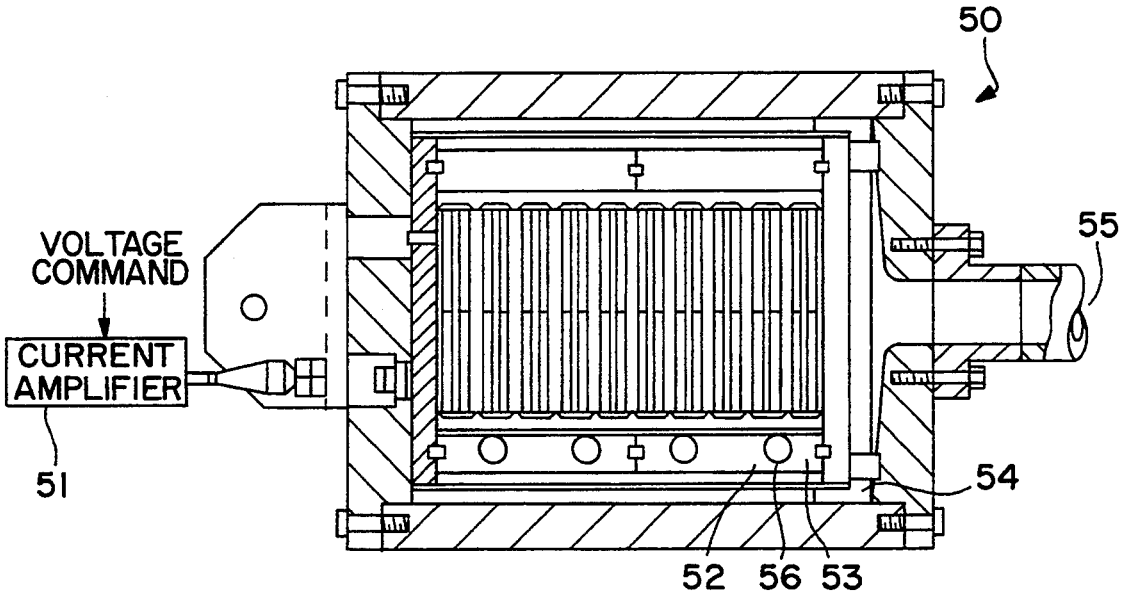
FIG. 4 is a schematic of a fluid displacement unit including a broadband solid state actuator element.

FIG. 4 is an embodiment of a fluid displacement unit 50 for use with the present invention. Composite actuator commands generated by the control unit are received by a power amplifier 51 that increases the magnitude of the current and applies it to coils 52 surrounding an actuator element 53. The current causes the coils to generate a magnetic field which induces magnetostriction of the actuator element, thereby causing a change in its length. This length change causes a diaphragm 54 surrounding the actuator element, ideally comprising a slotted cylinder, to expand and contract. This action results in a fluid pressure and volume change on an output port 55 of the fluid displacement unit 50 which propagates within the enclosure. Since the composite actuator commands correspond to a cancellation signal for the originally perceived radiating vibrations in the enclosure, these propagated pressure oscillations result in cancellation of the internal pressure fluctuations that would otherwise radiate from the enclosure walls as acoustic waves.

The actuator element 53 of the fluid displacement unit 50 preferably comprises a broadband solid state actuator element including a magnetostrictive alloy 56; for example, terfenol-D. Terfenol-D is an alloy capable of substantial magnetostriction at room temperatures, and comprises a combination of terbium, iron and dysprosium. Terfenol-D is ideal for the present application because of its high strain and force capacity and its low mechanical and electrical impedance. Nonetheless, other materials possessing similar qualities are also suitable for use in the present invention. For example, an electrostrictive alloy could be used in place of the magnetostrictive alloy. Examples of such materials include, but are not limited to, lead zirconate titanate (PZT) and lead magnesium niobate (PMN). In such an embodiment, the change in the length of the actuator element would be induced by generating an electric field using a capacitor, rather than a magnetic field using coils. Performance and design considerations for actuator elements of a type that may be used with the present invention are discussed in detail in Webbon et al., *Active Vibration Control Using Magnetostrictive Intra-Structural Actuators,* Second Conference on Recent Advances in Active Control of Sound and Vibration (1993).

While the fluid displacement unit described above is ideal for the present application, simpler piston-based, flex-tensional based or valve-based fluid displacement units may be sufficient where the fluid volume displacements required for cancellation are relatively small. In such units, the active actuator element causes a piston or a flex-tensional shell to move, thus causing pressure and volume fluctuations. Moreover, it will be clear to one skilled in the art that an alternative to having a fluid displacement unit external to an enclosure is to place a transducer directly inside the enclosure to generate the canceling waveforms.

While the present invention is described with reference to specific embodiments, it will be apparent to those skilled in the art that many modifications and variations are possible. Accordingly, the present invention embraces all alternatives, modifications and variations that fall within the spirit and scope of the appended claims, as well as all equivalents thereof.

What is claimed is:

1. An apparatus for reducing acoustic radiation from an enclosure containing a fluid, said apparatus comprising:

(A) one or more sensors for detecting a vibration in a surface of said enclosure, said one or more sensors being adapted to generate signals in response to detected vibration;

(B) a radiation filter coupled to said one or more sensors, said radiation filter including a signal processor, for assigning weight values to said signals from said one or more sensors, and for generating summation signals therefrom;

(C) a control unit coupled to said radiation filter, said control unit including a digital processor adapted to perform a cancellation algorithm on the summation signal and a reference signal for calculating cancellation waveforms corresponding to said summation signals, said cancellation algorithm comprising (a) means for calculating an estimated phase angle and an estimated frequency from said reference signal;

(b) means for generating a complex-valued analytic signal representing a first harmonic of the reference signal;

(c) a demodulating function adapted for performing a complex heterodyning of the analytic signal to generate a demodulated signal;

(d) a decoupling module adapted for recoupling the demodulated signal by performing a complex vector matrix multiplication with a vector of all degrees of freedom for the demodulated signal and a matrix representing a multi-channel inverse transfer function at the estimated frequency;

(e) means for converting an output of the complex vector matrix multiplication to a disturbance rejection signal by subjecting the output to an integral control law; and (f) a remodulating function for converting the disturbance rejection signal back to the estimated frequency; and (D) a fluid displacement unit in communication with said fluid, and coupled to said control unit for receiving said cancellation waveforms, said fluid displacement unit being capable of imparting, to said fluid, a pressure oscillation corresponding to said cancellation waveforms, to thereby reduce acoustic radiation, said fluid displacement unit comprising a solid state actuator element surrounded by an electroconductive coil, said coil being capable of generating a magnetic field around said actuator element upon application of an electric current, said actuator element being capable of undergoing magnetostriction in response to said magnetic field.

2. A method for reducing acoustic radiation from an enclosure containing a fluid, the method comprising:

(A) generating a signal corresponding to acoustic radiation from one or more surfaces of said enclosure;

(B) filtering said signal to generate a filtered signal;

(C) obtaining a reference signal for use in calculating the cancellation waveform;

(D) calculating a cancellation waveform corresponding to the filtered signal by executing a cancellation algorithm by the steps of (a) calculating an estimated phase angle and an estimated frequency from said reference signal;

(b) generating a complex-valued analytic signal representing a first harmonic of said reference signal;

(c) generating a demodulated signal by performing a complex heterodyning of said analytic signal;

(d) decoupling said demodulated signal by performing a complex vector matrix multiplication with a vector of all degrees of freedom for the demodulated signal and a matrix representing a multi-channel inverse transfer function at said estimated frequency;

(e) converting a result of said complex vector matrix multiplication step to a disturbance rejection signal by subjecting said result to an integral control law; and (f) remodulating said disturbance rejection signal back to said estimated frequency; and (E) imparting a pressure oscillation to said fluid corresponding to said cancellation waveform to reduce acoustic radiation.

* * * * *

UNITED STATES PATENT AND TRADEMARK OFFICE

CERTIFICATE OF CORRECTION

PATENT NO. : 5,394,376

DATED : February 28, 1995

INVENTOR(S) : Riddle et al

It is certified that error appears in the above-indentified patent and that said Letters Patent is hereby corrected as shown below:

Column 7, line 8, "$\hat{f}$" should read --$\hat{f}$ --.

Column 9, line 41, "recoupling" should read --decoupling--.

Signed and Sealed this

Seventh Day of November, 1995

Bruce Lehman

*Attest:*

BRUCE LEHMAN

*Attesting Officer*

*Commissioner of Patents and Trademarks*